US008737851B2

(12) United States Patent
Inukai et al.

(10) Patent No.: US 8,737,851 B2
(45) Date of Patent: May 27, 2014

(54) IMAGE FORMING APPARATUS WITH ABNORMAL DISCHARGE DETECTION

(75) Inventors: Katsumi Inukai, Iwakura (JP); Tsuyoshi Maruyama, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 195 days.

(21) Appl. No.: 13/073,048

(22) Filed: Mar. 28, 2011

(65) Prior Publication Data

US 2012/0082470 A1 Apr. 5, 2012

(30) Foreign Application Priority Data

Sep. 30, 2010 (JP) ..... 2010-222262

(51) Int. Cl.
*G03G 15/02* (2006.01)
*G03G 15/00* (2006.01)

(52) U.S. Cl.
USPC ..... 399/31; 399/37

(58) Field of Classification Search
USPC ..... 399/31, 37, 50, 170, 171, 89
See application file for complete search history.

(56) References Cited

U.S. PATENT DOCUMENTS

| | | | | |
|---|---|---|---|---|
| 4,583,836 | A * | 4/1986 | Taniguchi et al. | 399/31 |
| 7,620,335 | B2 * | 11/2009 | Inukai | 399/31 |
| 7,986,889 | B2 * | 7/2011 | Hamaya | 399/31 |
| 8,019,241 | B2 * | 9/2011 | Hamaya | 399/31 |
| 8,301,044 | B2 * | 10/2012 | Hamaya et al. | 399/31 |
| 2009/0060535 | A1 | 3/2009 | Hamaya | |
| 2010/0080593 | A1 * | 4/2010 | Inukai et al. | 399/50 |
| 2010/0278547 | A1 * | 11/2010 | Maruyama et al. | 399/31 |

FOREIGN PATENT DOCUMENTS

| | | | |
|---|---|---|---|
| JP | 59228267 | A * | 12/1984 |
| JP | 63-148276 | A | 6/1988 |
| JP | 64-77074 | A | 3/1989 |
| JP | 02173678 | A * | 7/1990 |
| JP | 03-089264 | A | 4/1991 |
| JP | 03-289321 | A | 12/1991 |
| JP | 05168230 | A * | 7/1993 |
| JP | 7-281512 | A | 10/1995 |
| JP | 8-123144 | A | 5/1996 |
| JP | 09-015944 | A | 1/1997 |
| JP | 2006-243542 | A | 9/2006 |
| JP | 2008304526 | A * | 12/2008 |
| JP | 2009-053422 | A | 3/2009 |
| JP | 2010-79045 | A | 4/2010 |

OTHER PUBLICATIONS

Japanese Official Action dated Nov. 12, 2013 received in related application JP 2010-222262.

* cited by examiner

*Primary Examiner* — Robert Beatty
(74) *Attorney, Agent, or Firm* — Scully, Scott, Murphy & Presser PC

(57) ABSTRACT

An image forming apparatus includes: a photoconductor; a charger configured to charge the photoconductor, the charger having a discharge wire and a grid; a charge-voltage applying device configured to generate charge voltage and apply the charge voltage to the discharge wire; and an abnormal-discharge detector provided between an output end portion of the charge-voltage applying device and the ground. The abnormal-discharge detector is configured to detect an abnormal discharge occurring in the charger by detecting an abnormal current passing via the grid and the ground upon occurrence of the abnormal discharge.

5 Claims, 5 Drawing Sheets

IMAGE FORMING APPARATUS WITH ABNORMAL DISCHARGE DETECTION

CROSS REFERENCE TO RELATED APPLICATION

This application claims priority from Japanese Patent Application No. 2010-222262 filed on Sep. 30, 2010. The entire content of this priority application is incorporated herein by reference.

TECHNICAL FIELD

The present invention relates to image forming apparatuses or, specifically, to detecting an abnormal discharge in the image forming apparatus.

BACKGROUND

A conventional image forming apparatus includes a charger having a discharge wire and a grid, i.e. a scorotron charger. In order to detect an abnormal discharge, the image forming apparatus has a discharge detection circuit connected to the grid. The discharge detection circuit detects an abnormal discharge (a spark discharge) occurred in the scorotron charger due to dust on the wire etc.

The discharge detection circuit can suitably detect the abnormal discharge caused between the discharge wire and the grid of the charger. However, because the charge voltage is high (e.g. ranging from 6 kV to 8 kV), an abnormal discharge may occur also in a charge voltage path to the charger.

Therefore, there is a need for an image forming apparatus that can detect: an abnormal discharge in a charger thereof; and, furthermore, an abnormal discharge due to the charge voltage in a charge voltage path to the charger.

SUMMARY

An aspect of the present Invention is an image forming apparatus including: a photoconductor; a charger configured to charge the photoconductor, the charger having a discharge wire and a grid; a charge-voltage applying device configured to generate charge voltage and apply the charge voltage to the discharge wire; and an abnormal-discharge detector provided between an output end portion of the charge-voltage applying device and the ground. The abnormal-discharge detector is configured to detect an abnormal discharge occurring in the charger by detecting an abnormal current passing via the grid and the ground upon occurrence of the abnormal discharge.

DETAILED DESCRIPTION

First Illustrative Aspect

A first illustrative aspect will be described with reference to FIGS. 1 and 2.

1. Schematic Configuration of Printer

Figure 1:
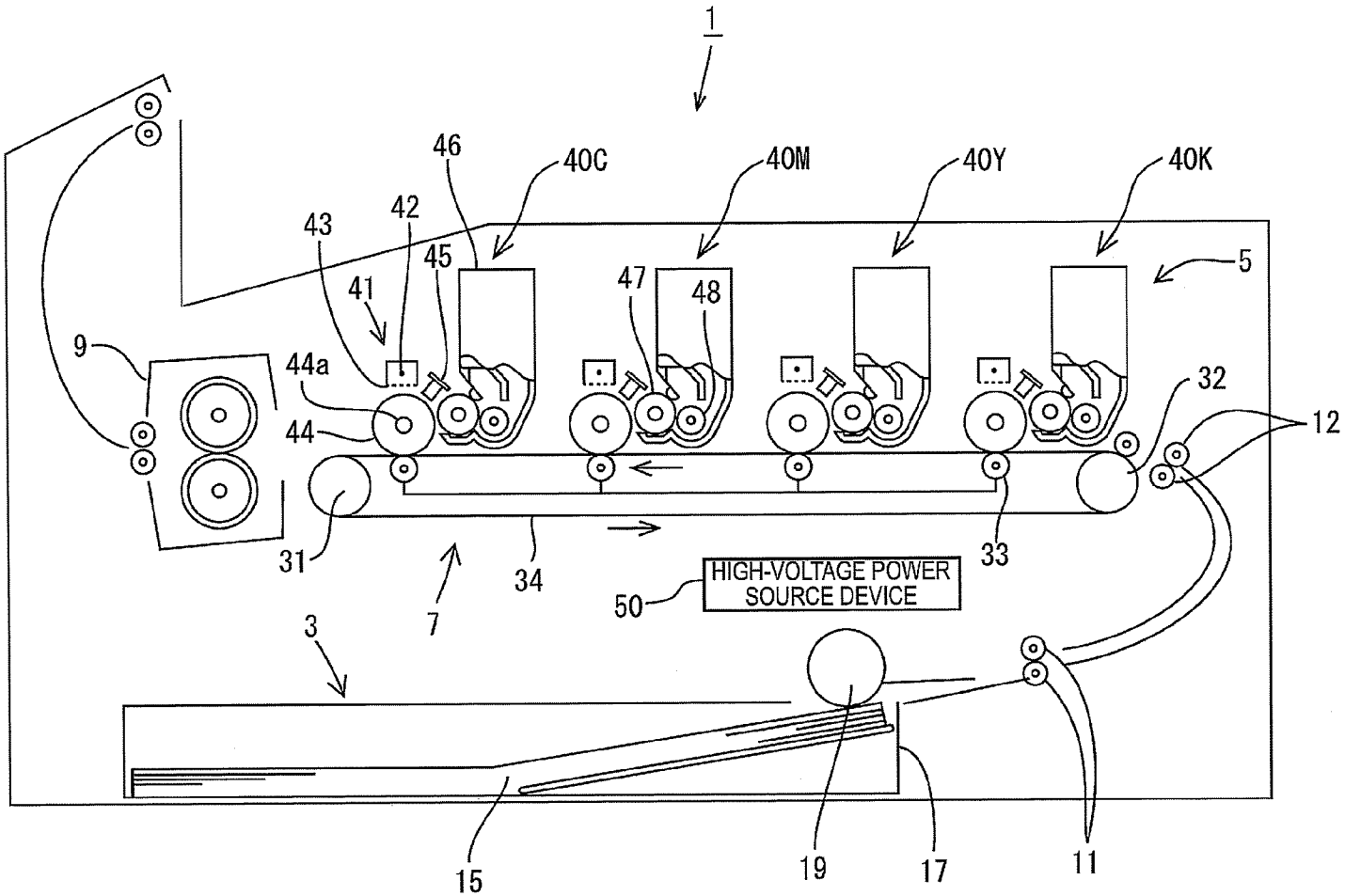
FIG. 1 is a schematic cross-sectional view illustrating internal configuration of a printer of a first illustrative aspect.
Figure 2:
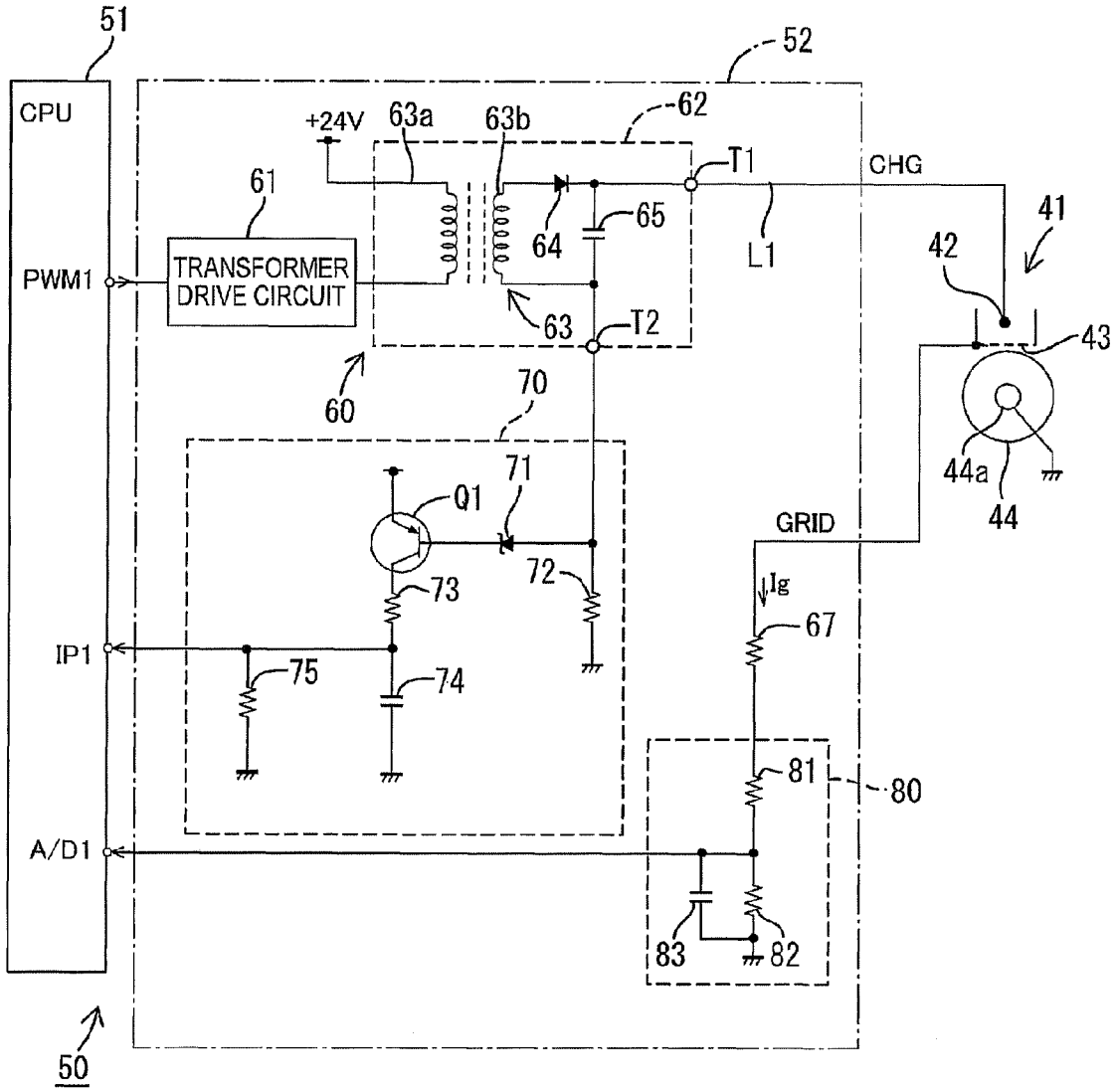
FIG. 2 is a schematic circuit diagram of a high-voltage power source device of the first illustrative aspect.

FIG. 1 is a schematic cross sectional view illustrating internal configuration of a color printer 1 (an illustration of an image forming apparatus) of a first illustrative aspect. Hereinafter, where the components are distinguished by their assigned toner colors, each component will be designated by reference characters accompanied with respective additional characters of Y (yellow), M (magenta), C (cyan), and K (black). On the other hand, where the components are not distinguished by their assigned toner colors, the additional characters are omitted. Note that the image forming apparatus is not limited to the color printer. For example, the image forming apparatus may be a multifunction machine having facsimile and copy functions.

The color printer (hereinafter referred to simply as "the printer") 1 includes a sheet supply unit 3, an image forming unit 5, a conveyer mechanism 7, a fixing unit 9, and a high-voltage power source device 50. The printer 1 forms toner images on sheets 15 (paper sheets, OHP sheets, etc.) according to external input image data and using toner (developer) of a single color or a plurality of (four (yellow, magenta, cyan and black) in this illustrative aspect) colors.

The sheet supply unit 3 is disposed in a bottom portion in the printer 1. The sheet supply unit 3 includes a tray 17 and a pickup roller 19. The tray 17 stores the sheets 15. The pickup roller 19 picks up the sheets 15 one by one from the tray 17. The sheet 15 is then sent to the conveyer mechanism 7 via a conveyer roller 11 and a registration roller 12.

The conveyer mechanism 7 for conveying the sheets 15 is removably mounted to a predetermined mount portion (not illustrated in the figures) in the printer 1. The conveyer mechanism 7 includes a driving roller 31, a driven roller 32, and a belt 34. The belt 34 is looped around the driving roller 31 and the driven roller 32. As the driving roller 31 rotates, the belt 34 moves such that its surface which is opposed to photosensitive drums 44 moves from right to left in FIG. 1. Thus, the sheet 15 sent from the registration roller 12 is conveyed to the image forming unit 5. In addition, the conveyer mechanism 7 includes four transfer rollers 33.

The image forming unit 5 includes four process units 40Y, 40M, 40C, 40K and four exposure devices 45. Each process unit 40 includes a scorotron charger 41, the photosensitive drum (an illustration of a photoconductor) 44, a unit case 46, a developer roller 47, and a supply roller 48. The process units 40Y, 40M, 40C, 40K are removably mounted to respective predetermined mount portions (not illustrated in the figures) in the printer 1.

The photosensitive drum 44 has an aluminium base material and a positively chargeable photosensitive layer on the aluminium base material. The aluminium base material is connected to, for example, the ground line of the printer 1 via a conductive shaft 44*a*. The scorotron charger (hereinafter referred to simply as "the charger") 41 is a charger of a scorotron type, having a discharge wire 42 and a grid 43. Charge voltage CHG is applied to the discharge wire 42. Grid voltage GRID, which is applied to the grid 43, is controlled so that surface potential of the photosensitive drum 44 is substantially uniform (e.g. +700V).

The exposure device 45 has a plurality of light emitting elements (for example, LEDs) that are aligned parallel to the rotation axis of the photosensitive drum 44. The light emitting elements are controlled so as to emit light corresponding to the external input image data, thereby forming an electrostatic latent image on the surface of the photosensitive drum 44. The exposure device 45 is fixedly installed in the printer 1. Note that the exposure device 45 may also be of a laser type.

The unit case 46 stores toner (positively chargeable non-magnetic single-component toner in this illustrative aspect) of the assigned color. The unit case 46 has the developer roller 47 and the supply roller 48. The supply roller 48 rotates to supply the toner to the developer roller 47. The toner is then positively charged by friction between the supply roller 48 and the developer roller 47. Thereafter, the developer roller 47 supplies the toner onto the photosensitive drum 44 to form a uniform and thin layer. Thus, the electrostatic latent image is developed into the toner image on the photosensitive drum 44.

Each transfer roller 33 is arranged in a position in which the transfer roller 33 and the corresponding photosensitive drum 44 hold the belt 34 therebetween. The transfer roller 33 is applied with transfer voltage. The polarity (negative in this illustrative aspect) of the transfer voltage is opposite to the polarity of the charged toner. Thus, the toner image on the photosensitive drum 44 is transferred to the sheet 15. Thereafter, the sheet 15 is conveyed by the conveyer mechanism 7 to the fixing unit 9, where the toner image is fused. Finally, the sheet 15 is ejected onto the upper face of the printer 1.

2. Configuration of High-voltage Power Source Device

Electrical configuration of the printer 1 related to the present invention will next be described with reference to FIG. 2. FIG. 2 is an illustration of a schematic block diagram of the high-voltage power source device 50 mounted to a circuit board (not illustrated in the figures) and connection configuration related to the high-voltage power source device 50.

The high-voltage power source device 50 includes a CPU (an illustration of a part of an abnormal-discharge detector and a controller) 51 and high-voltage power source circuits 52 connected to the CPU 51. The CPU 51 controls the high-voltage power source circuits 52 and, further, controls over the whole of the printer. Note that the controller is not limited to the CPU; for example, the controller may be an ASIC (application specific integrated circuit).

Each high-voltage power source circuit 52 includes a charge-voltage generation circuit (an illustration of a charge-voltage applying device) 60, a suppression resistor 67, an abnormal-discharge detection circuit (an illustration of a part of the abnormal-discharge detector) 70, and a grid-current detection circuit (an illustration of a grid-current detector) 80. The high-voltage power source circuits 52 are provided to respective chargers 41K-41C. Since the high-voltage power source circuits 52 are identical in configuration, only one of the high-voltage power source circuits 52 is illustrated in FIG. 2.

The charge-voltage generation circuit 60 includes a transformer drive circuit 61 and a step-up circuit 62. The charge-voltage generation circuit 60 generates the charge voltage CHG and applies the charge voltage CHG to the discharge wire 42 of the charger 41. As the charge voltage CHG is applied to the discharge wire 42, discharge occurs from the discharge wire 42 toward the grid 43. This discharge generates the grid voltage GRID in the grid 43. The charge voltage CHG ranges, for example, from 5.5 kV to 8 kV. The grid voltage GRID is, for example, approximately 700 V.

The transformer drive circuit 61 receives, for example, a PWM (pulse width modulation) signal from a port PWM1 of the CPU 51, smoothes the PWM signal and, based on the smoothed PWM signal, applies an oscillation current to a primary winding 63*a* of a transformer 63 of the step-up circuit 62. Then, in this illustrative aspect, the value of the charge voltage CHG is controlled according to the duty ratio of the PWM signal such that, for example, the greater the duty ratio of the PWM signal is, the greater the charge voltage CHG generated by the step-up circuit 62.

The step-up circuit 62 includes, for example, the transformer 63, a rectifier diode 64, and a smoothing capacitor 65. With this configuration, the voltage in the primary winding 63*a* of the transformer 63 is stepped up via a secondary winding 63*b* and is rectified and smoothed by the rectifier diode 64 and the smoothing capacitor 65, so that the charge voltage CHG is generated. The charge voltage CHG is applied to the discharge wire 42 of the charger 41.

Note that the configuration of the charge-voltage generation circuit 60 that generates the high-voltage charge voltage CHG, i.e. the configuration of the step-up circuit 62, does not have to include the transformer 63; the step-up circuit 62 may exclude the transformer 63.

The abnormal-discharge detection circuit 70 is provided between a low-potential side output end portion (an illustration of an output end portion) T2 of the charge-voltage generation circuit 60 and the ground. The abnormal-discharge detection circuit 70 detects the spark discharge (an illustration of an abnormal discharge) occurring in the charger 41 by detecting an abnormal discharge current that momentarily passes via the grid 43 and the ground due to the spark discharge. The low-potential side output end portion T2 is connected to the low-potential side of the secondary winding 63*b* of the transformer 63.

The grid-current detection circuit 80 is provided between the grid 43 and the ground. Thus, when the charge voltage CHG is applied from the high-potential side of the secondary winding 63*b* of the transformer 63 to the charger 41 in the above-described connection configuration, a grid current (substantially equal to a charge current) Ig returns to the low-potential side of the secondary winding 63*b* of the transformer 63 via the grid-current detection circuit 80, the abnormal-discharge detection circuit 70, and the low-potential side output end portion T2. Furthermore, upon occurrence of the abnormal discharge in the charger 41, the abnormal-discharge detection circuit 70 detects the abnormal discharge by detecting the abnormal discharge current passing via the grid-current detection circuit 80. Therefore, the above connection configuration makes it possible to suitably detect the grid current Ig and the abnormal discharge.

The abnormal-discharge detection circuit 70 includes, for example, a zener diode 71, a current detection resistor (an illustration of a detection resistor) 72, a transistor Q1, resistors 73, 75, and a capacitor 74.

One end of the current detection resistor 72 is connected to the low-potential side output end portion T2 of the charge-voltage generation circuit 60, while the other end is grounded. The current detection resistor 72 is used for detecting the abnormal discharge current due to the spark discharge. Actually, the current detection resistor 72 detects the voltage due to the abnormal discharge current.

More specifically, upon occurrence of the spark discharge between the discharge wire 42 and the grid 43, the grid current Ig passing through the grid 43 varies intermittently and greatly. Then, when the voltage detected by the current detection resistor 72 intermittently reaches the zener voltage of the zener diode 71, the transistor Q1 correspondingly turns on. In other words, the transistor Q1 turns on at every occurrence of the spark discharge between the discharge wire 42 and the grid 43 at a predetermined level or greater. The ON signal from the transistor Q1 is integrated by the resistor 73 and the capacitor 74 and is applied to an input port IP1 of the CPU 51. The CPU 51 detects occurrence of the spark discharge from the inputted ON signal. Note that the resistor 75 is a resistor for discharging the capacitor 74. In addition, upon detection of the spark discharge (the abnormal discharge), the CPU 51 may report the spark discharge to the user, prompting the user to clean the charger 41.

The grid-current detection circuit 80 includes a voltage dividing resistor 81, a grid-current detection resistor 82, and a capacitor 83. The grid-current detection circuit 80 detects the grid current passing through the grid 43. One end of the grid-current detection resistor 82 is connected to the voltage dividing resistor 81, while the other end is grounded. Then, a value of the voltage at a connection point P1 connecting the voltage dividing resistor 81 and the grid-current detection resistor 82 is applied to a port A/D1 of the CPU 51 as a detection signal corresponding to the grid current Ig. The CPU 51 controls the charge-voltage generation circuit 60 on the basis of the detection signal so that the grid current Ig is constant at a predetermined value.

Note that the capacitor 83 has a function of averaging the grid current Ig. Furthermore, the voltage dividing resistor 81 may be a zener diode having a predetermined zener voltage. In this case, the grid voltage can be maintained constant to some extent.

The CPU 51 controls the charge-voltage generation circuit 60 on the basis of the value detected by the grid-current detection circuit 80 so that the grid current Ig is constant. This stabilizes the operation of charging the photosensitive drum 44. The grid current Ig is detected using the detection value (a detection voltage value) detected by the grid-current detection resistor 82 and the resistance of the grid-current detection resistor 82.

The suppression resistor 67 is provided for suppressing the abnormal discharge energy upon occurrence of the spark discharge in the charger 41. The resistance of the suppression resistor 67 is, for example, 1 (one) MΩ. One end of the suppression resistor 67 is connected to the grid 43 of the charger 41, while the other end is connected to the voltage dividing resistor 81 of the grid-current detection circuit 80.

Effects of First Illustrative Aspect

Thus, in the first illustrative aspect, the abnormal-discharge detection circuit 70 is provided between the low-potential side output end portion T2 of the charge-voltage generation circuit 60 and the ground. This makes it possible to detect the abnormal discharge occurring between the discharge wire 42 and the grid 43 and, furthermore, the abnormal discharge occurring between the high-potential side output end portion T1 and the ground or between a charge voltage line L1 and the ground. In other words, the abnormal discharge in the charger 41 can be detected and, furthermore, an abnormal discharge occurring in the path of the charge voltage CHG to the charger 41 due to the charge voltage CHG can also be suitably detected.

Furthermore, the abnormal discharge in the charger 41 is detected by detecting the abnormal discharge current passing via the grid-current detection circuit 80. This makes it possible to detect the grid current Ig with higher accuracy and, furthermore, to suitably detect the abnormal discharge without providing an additional detection line for detecting the abnormal discharge in the charger 41.

Second Illustrative Aspect

Figure 3:
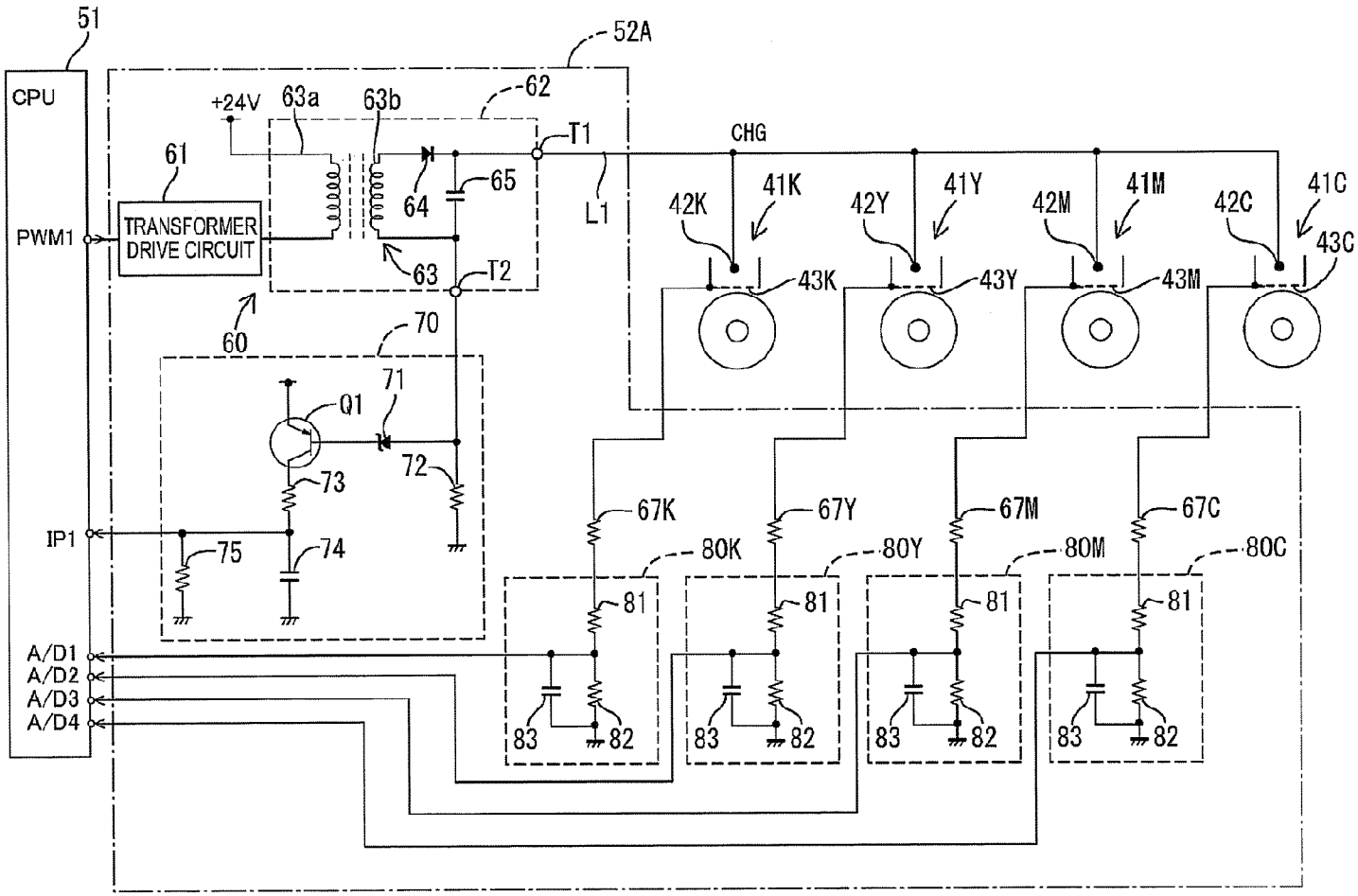
FIG. 3 is a schematic circuit diagram of a high-voltage power source device of a second illustrative aspect.

A second illustrative aspect will next be described with reference to FIG. 3. The second illustrative aspect differs from the first illustrative aspect only in that the charge-voltage generation circuit 60 of a high-voltage power source circuit 52A applies the charge voltage CHG in common to the chargers 41K, 41Y, 41M, 41C assigned to respective colors. Therefore, the configuration identical with the high-voltage power source circuit 52 will be designated with the identical reference characters, while the description will be omitted.

In this illustrative aspect, upon occurrence of the abnormal discharge in at least one of the chargers 41, the abnormal-discharge detection circuit 70 detects the abnormal discharge by detecting the abnormal current passing via the grid-current detection circuit 80 related to the charger 41 having the abnormal discharge therein.

Furthermore, the detection value (the detection voltage value) detected by the grid-current detection circuits 80K, 80Y, 80M, 80C are applied to respective ports A/D1, A/D2, A/D3, A/D4 of the CPU 51.

In other words, though the configuration of the second illustrative aspect is unavailable for identifying the charger 41 having the abnormal discharge therein, the configuration makes it possible to suitably detect the abnormal discharge occurring in at least one of the chargers 41 and, furthermore, the abnormal discharge occurring in the path of the charge voltage CHG to the charger 41 due to the charge voltage CHG by the single abnormal-discharge detection circuit 70.

Other Illustrative Aspects

The present invention is not limited to the illustrative aspects described above with reference to the drawings. For example, following illustrative aspects are also included within the scope of the present invention.

Figure 4:
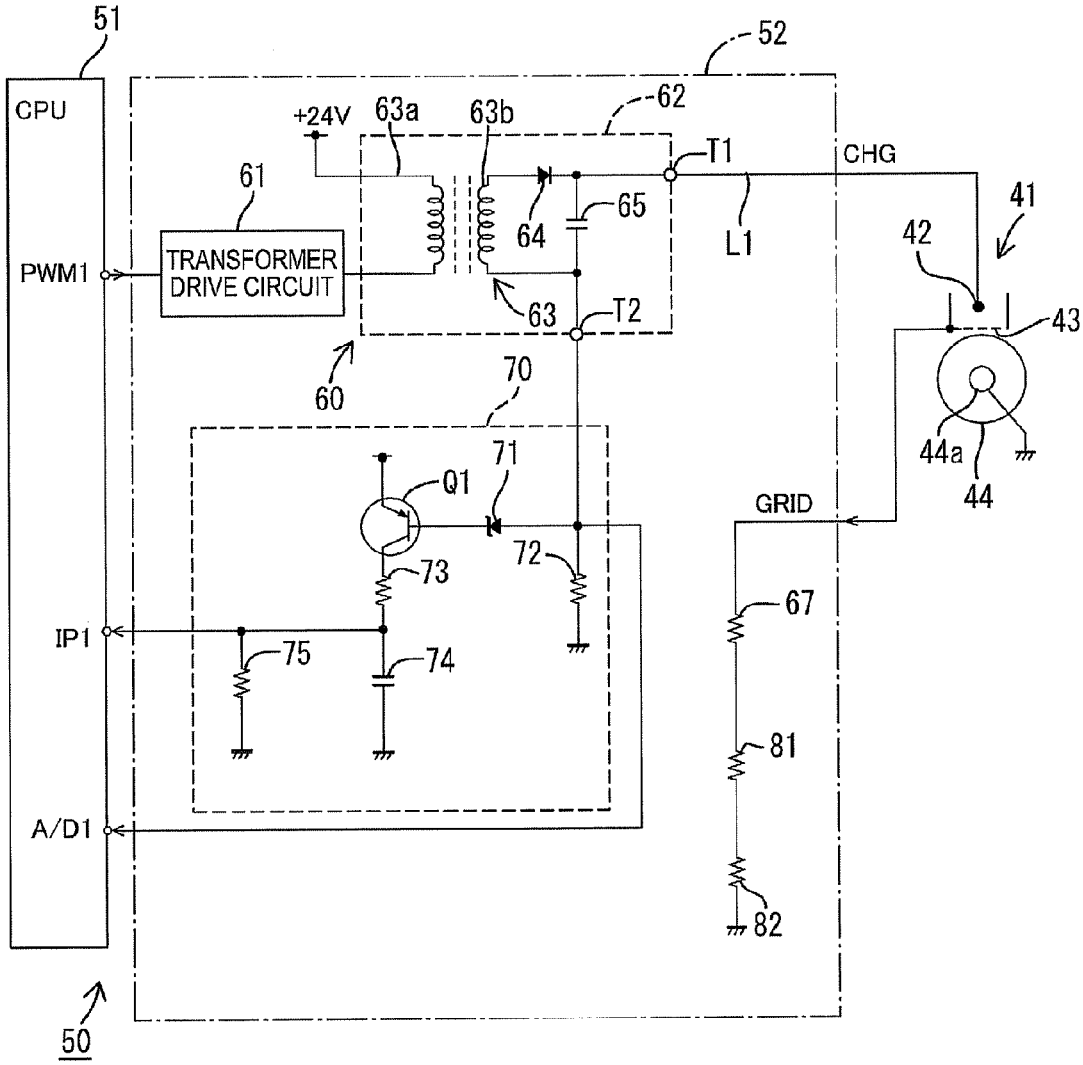
FIG. 4 is a schematic circuit diagram of another high-voltage power source device.

(1) In the first illustrative aspect, the detection value (the voltage detection value) detected by the current detection resistor 72 of the abnormal-discharge detection circuit 70 may be applied to the port A/D1 of the CPU 51 as the detection signal corresponding to the grid current (the charge current) Ig as illustrated in FIG. 4. In this case, the current detection resistor 72 can function as the resistor for detecting the abnormal discharge and, furthermore, as the resistor for detecting the grid current. This makes it possible to omit a part of the configuration related to the grid-current detection circuit 80.

Figure 5:
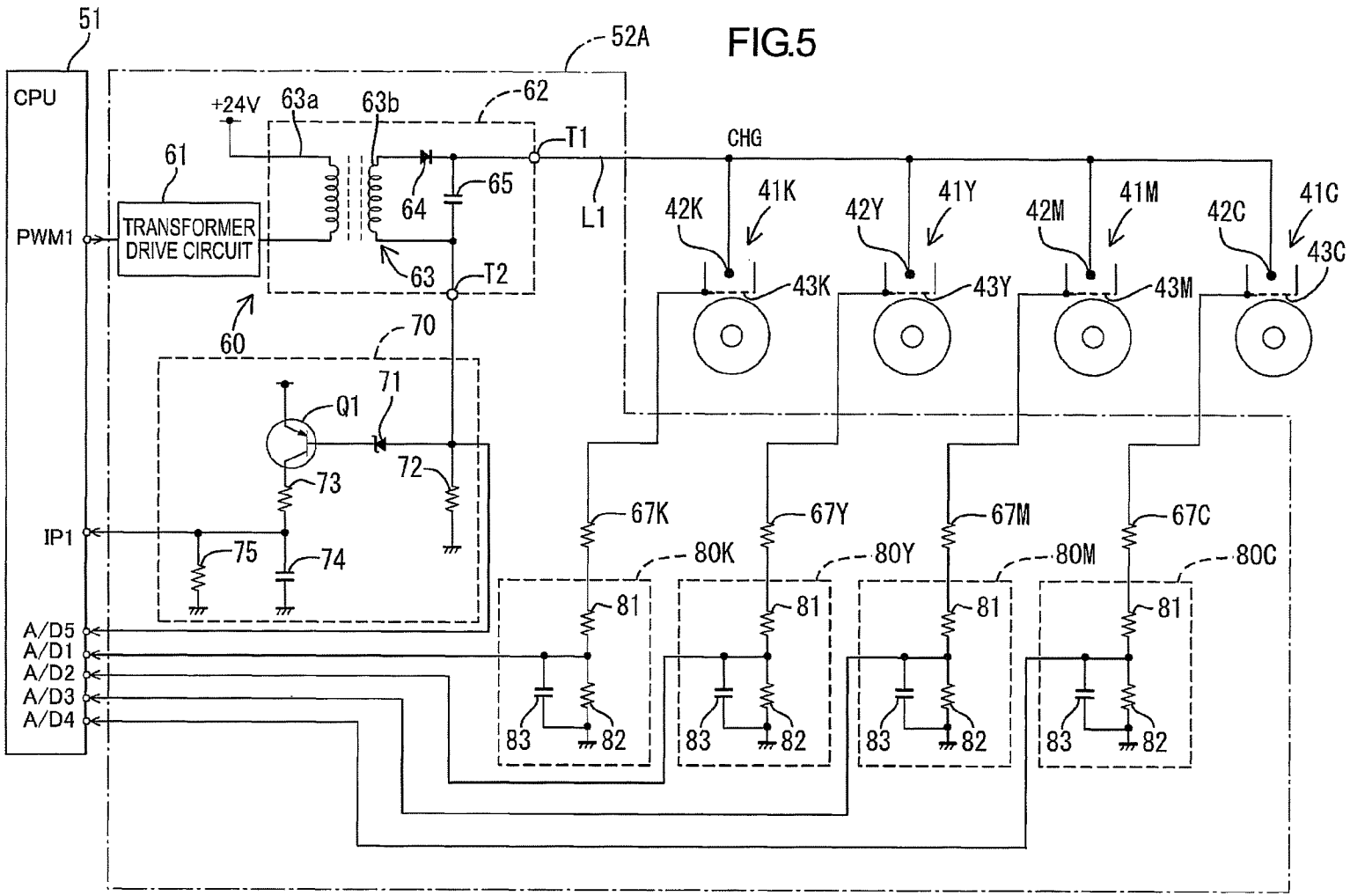
FIG. 5 is a schematic circuit diagram of another high-voltage power source device.

(2) In the second illustrative aspect, the value (the voltage detection value) detected by the current detection resistor 72 of the abnormal-discharge detection circuit 70 may be applied to a port A/D5 of the CPU 51 as the detection signal corresponding to the entire grid currents (the entire charge currents) Ig as illustrated in FIG. 5. In this case, the current detection resistor 72 can function as the resistor for detecting the abnormal discharge and, furthermore, as the resistor for detecting an abnormal current related to the entire grid currents (the entire charge currents) such as an overcurrent.

(3) In the above-described illustrative aspects, each photosensitive drum 44 is provided with respect to the corresponding one of the chargers 41 (in other words, the photosensitive drums 44 are provided illustratively for respective colors). The present invention is not limited to this. The present invention may be adopted in a printer having a plurality of chargers 41 that correspond to a single photosensitive drum, i.e. a printer (the image forming apparatus) that overlays the toner images of respective colors on the single photosensitive drum 44 and then transfers the images collectively onto the sheet.

What is claimed is:

1. An image forming apparatus comprising:

a photoconductor;

a charger configured to charge the photoconductor, the charger having a discharge wire and a grid;

a charge-voltage applying device configured to generate charge voltage and apply the charge voltage to the discharge wire;

an abnormal-discharge detector provided in series between an output end portion of the charge-voltage applying device and a ground, the abnormal-discharge detector being configured to detect an abnormal discharge occurring in the charger by detecting an abnormal current passing via the grid and the ground upon occurrence of the abnormal discharge; and a grid-current detector provided between the grid and the ground, the grid-current detector being configured to detect a grid current passing through the grid by the charge voltage applied to the discharge wire, wherein the abnormal-discharge detector detects the abnormal discharge by detecting the abnormal current passing via the grid-current detector and returning to the charge-voltage applying device.

2. The image forming apparatus according to claim 1, wherein: the abnormal-discharge detector includes a detection resistor provided between the output end portion of the charge-voltage applying device and the ground.

3. The image forming apparatus according to claim 1, wherein:

the photoconductor includes a single photoconductor or a plurality of photoconductors;

the charger includes a plurality of chargers, the chargers provided to the single photoconductor or to the respective photoconductors, the chargers configured to charge the single photoconductor or the respective photoconductors;

the grid-current detector includes a plurality of grid-current detectors, the grid-current detectors corresponding to the respective chargers;

the charge-voltage applying device applies the charge voltage in common to the chargers; and the abnormal-discharge detector detects the abnormal discharge by detecting the abnormal current passing via at least one of the grid-current detectors.

4. The image forming apparatus according to claim 3, wherein: the abnormal-discharge detector includes a detection resistor having a first end and a second end, the first end connected to a low-potential side output end portion of the charge-voltage applying device, and the second end grounded.

5. The image forming apparatus according to claim 1, wherein:

the charge-voltage applying device includes a transformer, and the output end portion of the charge-voltage applying device is connected to a low-potential side of the secondary winding of the transformer.

* * * * *